US005970933A

United States Patent [19]

Ueda et al.

[11] Patent Number: 5,970,933

[45] Date of Patent: Oct. 26, 1999

[54] OVERHEAD-VALVE ENGINE HAVING NON-PARALLEL INLET AND OUTLET VALVES

[75] Inventors: Yoshiteru Ueda; Tetsuhiro Yamakawa, both of Kakogawa, Japan; Shinichi Tanba, Maryville, Mo.; Ichirou Uemura, Maryville, Mo.; Atsuhiro Yoshimatsu, Maryville, Mo.

[73] Assignee: Kawasaki Jukogyo Kabushiki Kaisha, Japan

[21] Appl. No.: 08/978,318

[22] Filed: Nov. 25, 1997

[30] Foreign Application Priority Data

Nov. 29, 1996 [JP] Japan ..... 8-319382

[51] Int. Cl.[6] ..... F01L 1/00

[52] U.S. Cl. ..... 123/90.39; 123/193.5

[58] Field of Search ..... 123/90.39, 193.5, 123/90.27, 90.61, 90.41

[56] References Cited

U.S. PATENT DOCUMENTS

| | | | |
|---|---|---|---|
| 2,769,434 | 11/1956 | Witzky | 123/90.39 |
| 2,864,351 | 12/1958 | Leach . | |
| 3,276,438 | 10/1966 | Keinath . | |
| 3,949,715 | 4/1976 | Faix et al. | 123/193.5 |
| 4,593,662 | 6/1986 | Baring et al. | 123/90.39 |
| 4,724,803 | 2/1988 | Williams | 123/90.39 |

FOREIGN PATENT DOCUMENTS

| | | |
|---|---|---|
| 525086 | 4/1920 | France . |
| 05133205 | 5/1993 | Japan . |

*Primary Examiner*—Marguerite McMahon

*Attorney, Agent, or Firm*—Oppenheimer Wolff & Donnelly LLP

[57] ABSTRACT

A valve structure is disclosed which is mechanically simple and is suited for use in an overhead-valve engine having a hemi-spherical combustion chamber. In the valve structure, inlet valve 3 and exhaust valve 2 are positioned in such a manner that they incline substantially like a "V" in front view to form an acute angle therebetween. Positioned on a first inclined plane U1 are the longitudinal center lines 2*a*, 4*a* and 1*a* of the inlet valve 2, the associated push rod 4 and the associated rocker arm 1, which connects these, respectively. Positioned on a second inclined plane U2 are the longitudinal center lines 3*a*, 4*a* and 1*a* of the exhaust valve 3, the associated push rod 4 and the associated rocker arm 1, which connects these, respectively.

16 Claims, 11 Drawing Sheets

OVERHEAD-VALVE ENGINE HAVING NON-PARALLEL INLET AND OUTLET VALVES

FIELD OF THE INVENTION

The present invention relates to a valve structure for an overhead-valve engine. In particular, the invention relates to a valve structure for an overhead-valve engine having non-parallel inlet (intake) and outlet (exhaust) valves, allowing for large valve aperture areas.

BACKGROUND OF THE INVENTION

An overhead-valve (OHV) engine includes valves in the cylinder head and cams for driving the valves positioned in a lower portion of the engine. This arrangement results in a small, compact, lightweight design. Because OHV engines are mechanically simple, they can be manufactured inexpensively and maintained easily.

For these reasons, the OHV engine is used widely as a general-purpose engine in applications such as lawn mowers, working vehicles, portable generators, etc. The OHV engine is still used in these fields despite the appearance of overhead-cam (OHC) design engines capable of high revolution speeds and high-outputs.

In general, the larger the aperture areas in the inlet and outlet ports to the combustion chamber, the less restricted will be the air flow into and out of the chamber, resulting in more power and greater efficiency. It is therefore desirable to achieve larger aperture areas for the inlet and exhaust ports. In order to enlarge these ports, it is widely known to provide a hemi-spherical combustion chamber in the cylinder head, and to position an inlet valve and an exhaust valve in such a manner that they incline along the hemi-spherical surface of the combustion chamber. That is, each valve will move perpendicular to a tangent to the curved surface where the respective valve is located.

When the combustion chamber in the cylinder head is thus hemi-spherical, the ignition flame propagation distances can be relatively equal, and the chamber can be kept small. This improves combustion efficiency, and is advantageous for improvement of exhaust gas conditions, also.

In an OHC engine, the cams for driving the inlet and exhaust valves of the engine are positioned in the cylinder head. It is therefore relatively easy to enlarge the aperture areas of the inlet and exhaust ports by forming a hemi-spherical combustion chamber in the cylinder head and positioning the valves there in such a manner that they incline along the hemi-spherical surface of the combustion chamber.

In contrast, the cam shaft in an OHV engine is positioned in a lower portion of the engine. The cam rocks a rocker arm in an upper portion of the engine through a tappet and a push rod, so as to move up and down the inlet valve or the exhaust valve positioned in the cylinder head. In general, the inlet valve and the exhaust valve are positioned in such a manner that the center of the inlet valve and the center of the exhaust valve define a line that is parallel with the cam shaft. Therefore, if the combustion chamber in the cylinder head is hemi-spherical, and the directions in which the valves move are each inclined toward the center of the hemi-spherical chamber in order to enlarge the aperture areas of the inlet and exhaust ports, as is the case with an OHC engine, the direction in which each valve moves will not coincide with the direction in which the associated rocker arm rocks.

As a result, with respect to the direction in which the valves move, torsion is produced in the direction in which the associated rocker arm rocks. Consequently, the operation of a valve mechanism including the inlet valve, the exhaust valve, the rocker arm and the push rod is not smooth, and harmful or useless force is applied to parts of the valve mechanism. Therefore, deflective wear occurs on a support portion of the rocker arm. This can cause deformation in the rocker arm and the push rod in some conditions.

If the valve mechanism were to be made so rigid, strong and/or resistant to wear as to effectively resist deflective wear and deformation, this would increase the weight, size, and complexity of the valve mechanism.

In particular, in the case of an internal combustion engine which rotates at speeds in the thousands of revolutions per minute, the stresses repeatedly acting on the valve mechanism make may it necessary to replace parts of the valve mechanism often.

Japanese Patent Laid-Open Publication H.5-133205 discloses prior art relating to an OHV engine, in which the combustion chamber is hemi-spherical with the inlet and exhaust valves inclining toward the center of the chamber. This mechanism, however, does not solve the technical problems stated above.

SUMMARY OF THE INVENTION

In view of the foregoing, it is an object of the present invention to provide a valve structure and mechanism which may be used in an OHV engine having a cylinder head in which the combustion chamber is hemi-spherical, with the inlet valve and the exhaust valve non-parallel and inclining toward the center of the chamber, such that the inlet port and the exhaust port may be provided with large aperture areas.

According to a first aspect of the invention, an OHV internal combustion engine includes a valve mechanism comprising: an inlet (intake) valve for allowing air into a combustion chamber of the engine; an outlet (exhaust) valve for allowing exhaust gas out of the combustion chamber; an inlet rocker arm actuated by an inlet push rod for actuating the inlet valve; and an outlet rocker arm actuated by an outlet push rod for actuating the outlet valve; wherein: the outlet valve is inclined relative to the inlet valve to define an acute angle therebetween; respective longitudinal center lines of the inlet valve, the inlet push rod, and the inlet rocker arm lie substantially in a first plane; and respective longitudinal center lines of the outlet valve, the outlet push rod, and the outlet rocker arm lie substantially in a second plane. Because the intake and exhaust valves are inclined to one another, the valves are non-parallel.

In another aspect, a valve structure of an overhead-valve engine is characterized in that an inlet valve and an exhaust valve are positioned in such a manner as to incline substantially in the shape of a "V" in front view (herein, as viewed perpendicularly to the directions in which a piston reciprocates and to the axis of a crankshaft); that the longitudinal center lines of the inlet valve, a push rod on the inlet side, and a rocker arm connecting these, respectively, are positioned substantially in one inclined plane U1 (virtual inclined plane; refer to U1 in FIG. 10); and that the longitudinal center lines of the exhaust valve, a push rod on the exhaust side, and a rocker arm connecting these, respectively, are positioned substantially in a second inclined plane U2 (virtual inclined plane; refer to U2 in FIG. 10).

According to another aspect of the invention, the valve structure of an overhead-valve engine is characterized in that an inlet valve and an exhaust valve are positioned in such a manner as to incline substantially in the shape of a "V" in front view; that a rocker arm on the inlet side and a rocker arm on the exhaust side are positioned in the shape of a "V" in plan view in such a manner that the distance between their ends adjacent to the push rods is longer than the distance between their ends adjacent to the valves; that the longitudinal center lines of the inlet valve, the push rod on the inlet side, and the rocker arm connecting these, respectively, are positioned substantially in one inclined plane; and that the longitudinal center lines of the exhaust valve, the push rod on the exhaust side, and the rocker arm connecting these, respectively, are positioned substantially in a second inclined plane.

According to the valve structure of the overhead-valve engine described above, even though the inlet and exhaust valves are positioned in such a manner that they incline substantially like a "V" in front view, i.e., that the valves move in non-parallel directions, because the inlet valve and the inlet push rod move and the inlet rocker arm rocks substantially in a single plane, there is no twisting between the direction of the push rod motion and the direction of the rocker arm rocking motion. Consequently, the valves move smoothly during both opening and closing action, and useless force is not applied to parts of the valve mechanism. The same is true for the exhaust side, in which the exhaust valve and the exhaust push rode move and the exhaust rocker arm rocks substantially in a second plane. Therefore, without special arrangement or consideration in structure and/or material for a conventional OHV engine, the support portion of the rocker arm will experience little or no deflective wear, and the push rod and/or the rocker arm will deform little if at all.

Because the inlet and exhaust valves can be positioned in such a manner that they incline substantially like a "V" in front view, a combustion chamber in a cylinder head can be hemi-spherical, and the valves can be inclined toward the center of the chamber. As a result, an inlet port and an exhaust port can have large aperture areas. As an additional advantage, because the distance between the inlet port and the exhaust port in the cylinder head is substantial, the valve structure provides excellent cooling performance. Of course, a cooling passage can be formed between the inlet valve and the exhaust valve in the cylinder head, further improving the cooling performance.

Accordingly, without complicating the structure, an OHV engine is provided which exhibits high air flow efficiency, high combustion efficiency, low fuel consumption, and advantageous exhaust gas conditions as compared with a conventional OHV engine.

The rocker arm on the inlet side and a rocker arm on the exhaust side may be positioned in the shape of a "V" in plan view. That is, the longitudinal center line of the inlet rocker arm is inclined relative to the longitudinal center line of the outlet rocker arm to form an acute angle therebetween. Provided that the longitudinal center lines of each valve, its associated push rod, and its associated rocker arm which connects these are kept in a plane, the design can be modified for various configurations and the valve can be inclined at various angles. It is therefore possible to apply this valve structure to engines of various displacements.

It is preferable that a supporting structure of the center on which the rocker arm rocks is a spherical pivot support structure. In this case, the rocker arm can, with a simple structure, rock smoothly.

It is further preferable that the longitudinal center lines of the tappet and the associated push rod are aligned in front view, and that the cam surface of the cam shaft inclines perpendicularly to the longitudinal center line of the associated tappet in front view. In this case, when the rocker arm rocks, the driving force is transmitted from the associated cam surface linearly or straight through the associated tappet and the push rod to the rocker arm. As a result, the valve mechanism can operate more smoothly. Because the push rod is pushed by the tappet linearly along its axis, almost no eccentric load in the longitudinal direction of the camshaft is applied to the push rod. Therefore, a support portion of the tappet and upper and lower fulcrums of the push rod do not easily wear, and the push rod need not be designed with such a high buckling strength as would otherwise be necessary.

It is further preferable that the inlet and exhaust valves are positioned in such a manner as to incline substantially like a "V" in front view, and are inclined in such a manner that the valves form an acute (non-parallel) angle with the push rods, with the valve stems spaced more closely to the push rods than are the valve heads, in side view. In this case, it is possible to make the layout of the valve structure more compact, and to position the ignition plug nearer to the center of the combustion chamber.

BRIEF DESCRIPTION OF THE DRAWINGS

FIG. 8(*a*) is a plan view. FIG. 8(*b*) is a cross section taken along section line 6—6 of FIG. 8(*a*). FIG. 8(*c*) is a detail of the lower portion "8*c*" of FIG. 8(*b*). FIG. 8(*d*) is a detail of the left most portion "8*d*" of FIG. 8(*b*).

FIG. 10(*a*) is a diagrammatic front view of the engine. FIG. 10(*b*) is a diagrammatic (left side) view taken along line b—b of FIG. 10(*a*). FIG. 10(*c*) is a diagrammatic (plan) view taken along line c—c of FIG. 10(*a*).

DETAILED DESCRIPTION OF AN ILLUSTRATIVE EMBODIMENT

With reference to the drawings, a valve structure of an overhead-valve engine according to an illustrative embodiment of the present invention will be described below. In the illustrative embodiment, the invention is applied to an air-cooled general-purpose engine.

Figure 1:
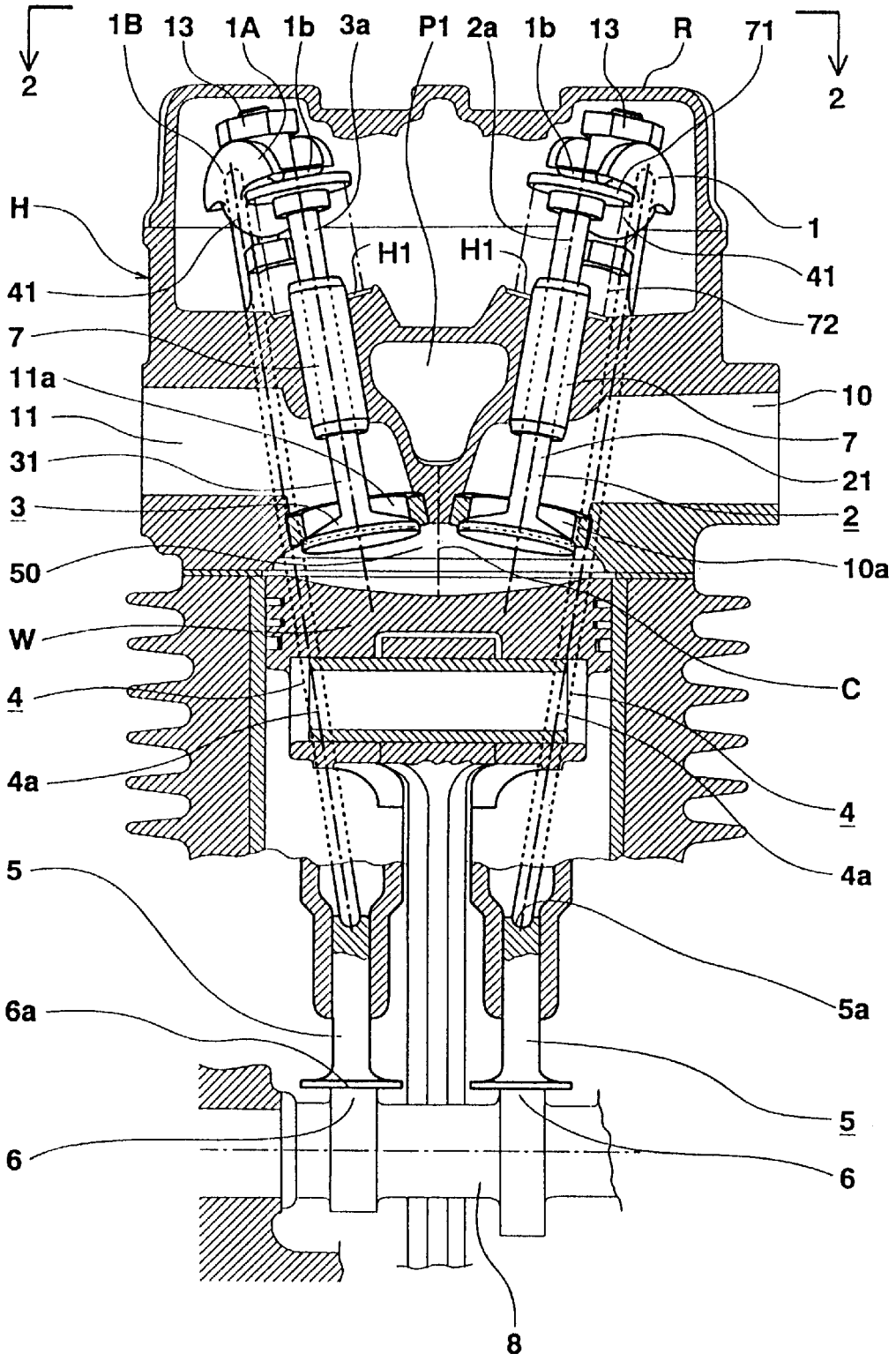
FIG. 1 is a cross sectional view in front view taken along section line 1—1 of FIG. 2, showing the valve structure of an overhead-valve engine according to an embodiment of the invention. An upper part of FIG. 1 is a cross section taken along the valve stems, and a lower part is a cross section taken along the tappets.
Figure 3:
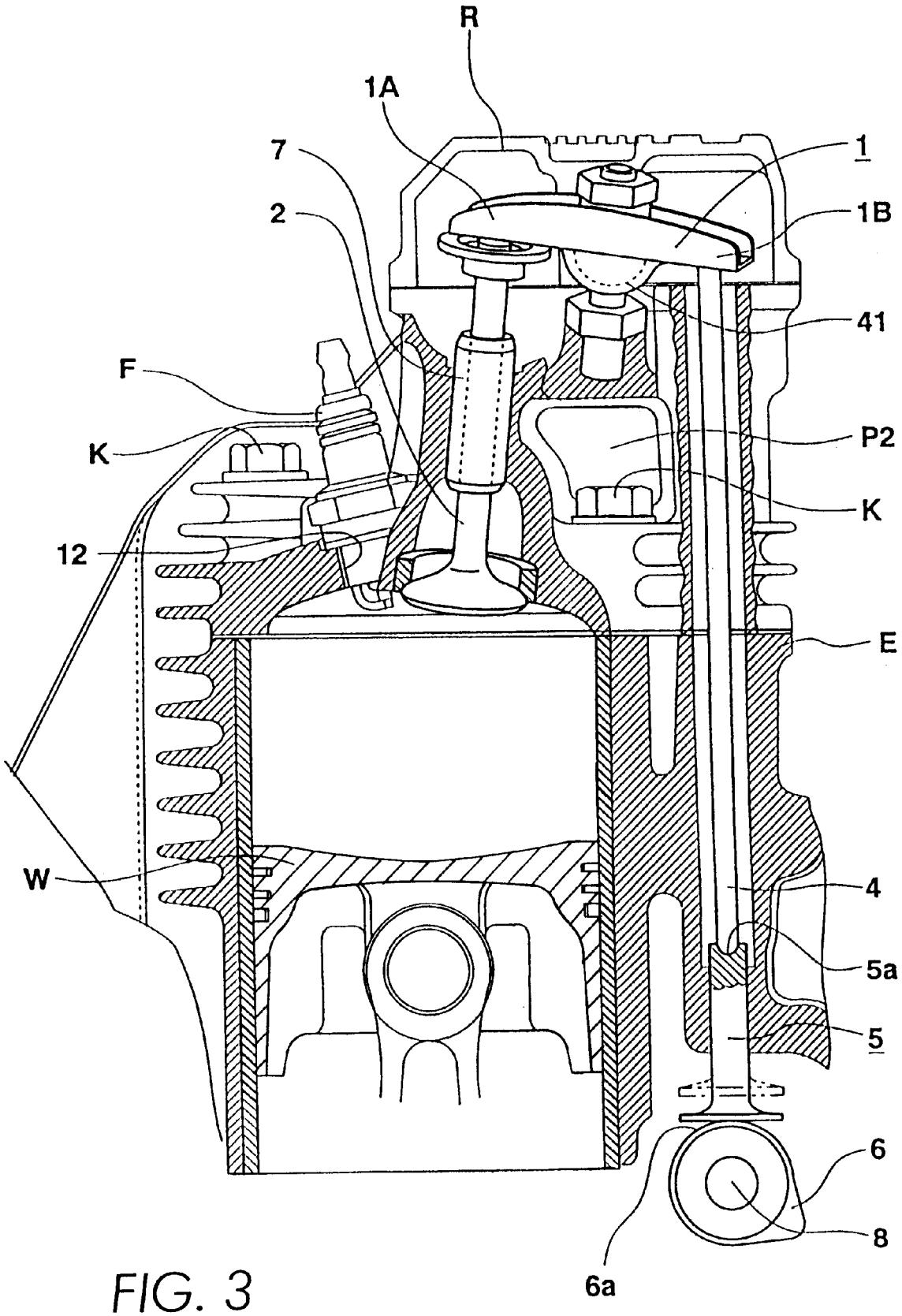
FIG. 3 is a cross section viewed along section line 3—3 of FIG. 2 and so taken along the plane (virtual plane) on which the rocker arm, the valve and the push rod on the exhaust side extend that these parts appear.
Figure 4:
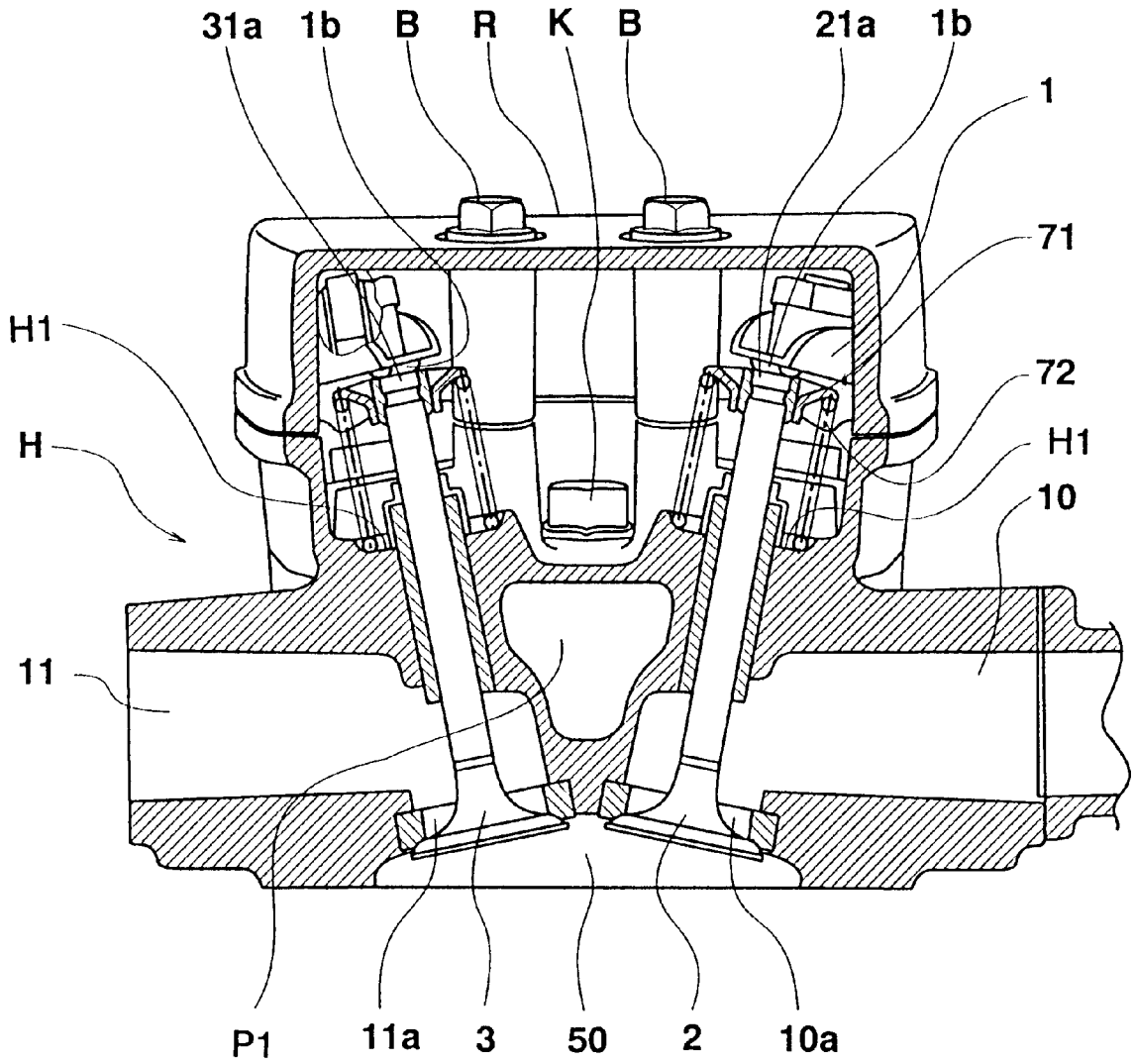
FIG. 4 is a cross section viewed from section line 1—1 of FIG. 2 and so taken along the plane on which the valves on the exhaust and inlet sides extend as to show the structure of the cylinder head and parts near the head in detail.

FIG. 1 is a cross-sectional side view of an air-cooled engine according to the present invention. The engine includes cylinder head H, rocker arm 1, exhaust valve 2, inlet valve 3, push rods 4, and tappets 5 which follow cam 6. The exhaust valve 2 and the inlet valve 3 are arranged such that they incline substantially in the shape of a "V" in front view. In other words, in front view, the axes of the valves 2 and 3 extend toward the center line C of a combustion chamber 50 in the shape of a "V", thus forming an acute angle between the respective longitudinal center lines of these valves. As shown in FIG. 3, the exhaust valve 2 and the inlet valve 3 are arranged in such a manner that the valves form an acute (non-parallel) angle with the push rods, with the valve stems spaced more closely to the push rods than are the valve heads, in side view. The stem 21 (FIG. 1) of the valve 2 and the stem 31 of the valve 3, respectively, are axially and slidably supported by a valve guide 7 fixed to the cylinder head H. As shown in FIG. 4, which shows the structure of the cylinder head H and the near portion of the cylinder head H in detail, a valve spring 72 is fitted between a spring retainer 71 fixed to each of the inlet valve 2 and the exhaust valve 3 and a spring seat H1 formed in the cylinder head H. The force of the spring 72 urge the valves 2, 3 upward in FIG. 4. When the rocker arm 1 pushes down the stem head 21*a* or 31*a* of the associated valve 2 or 3, the valve 2 or 3 moves down (to open the valve) against the force of the associated spring 72. As shown in FIG. 8, the rocker arm 1 of this embodiment includes a hemi-spherical pivot support receiving portion 41 in the middle, which is a pivotal center, a rounded hemi-cylindrical convex valve push portion 1*b* at the one end 1A for contact with the valve, and a rounded hemi-spherical concave rod seat 1*c* for contact with the push rod at the other end 1B. These portions 41, 1*b* and 1*c* of the rocker arm are pressed integrally out of a plate member.

As shown in FIGS. 1 and 3–5, the cylindrical valve push portions 1*b* of the rocker arms 1 are positioned over the stem heads 21*a* and 31*a* of the valves 2 and 3, respectively, in such a manner that they can push the stem heads 21*a* and 31*a* (see FIG. 4). When the valve push portions 1*b* move down, the rocker arms 1 contact the stem heads 21*a* and 31*a*. When the rocker arms 1 do not move, but are positioned up, a valve clearance is formed between the stem head 21*a* and the associated push portion 1*b*, and another clearance is formed between the head 31*a* and the associated push portion 1*b*.

Figure 9:
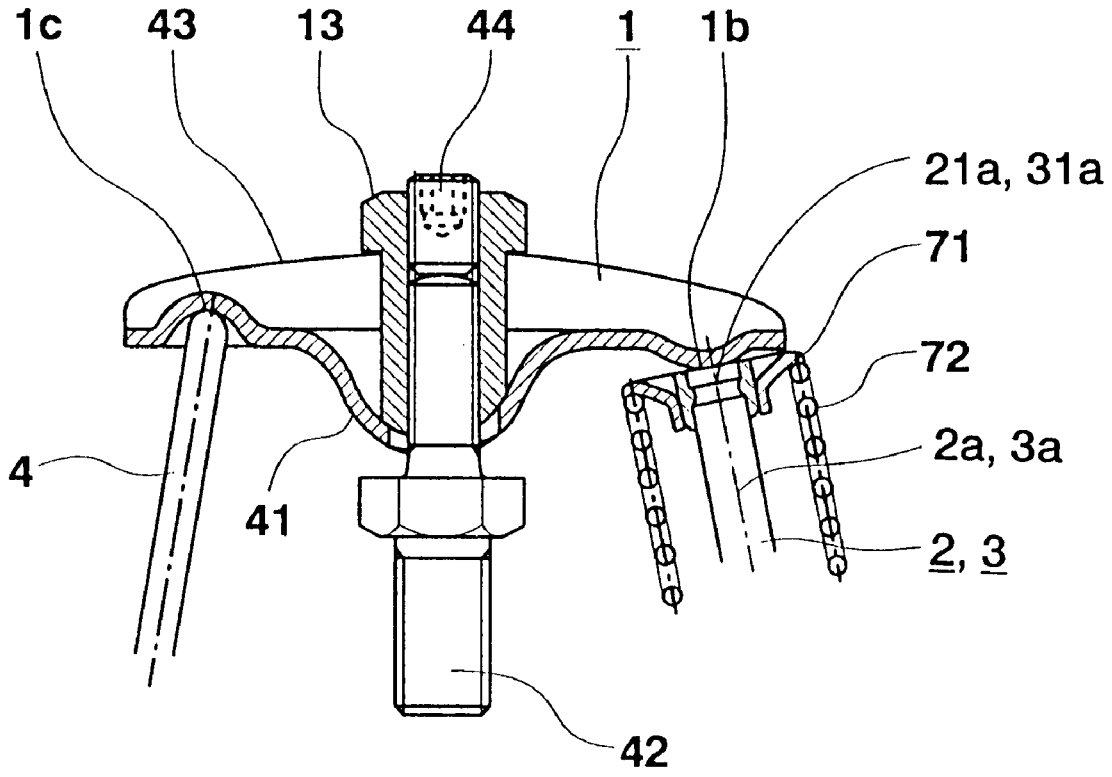
FIG. 9 is a cross section showing the structure of the rocker arms, push rods and valves of the embodiment.

As shown in FIG. 9, the top of the push rod 4 engages with the seat 1*c* at the end 1B opposite the valve push portion 1*b* of the rocker arm 1, which is shown in FIG. 8, in such a manner that the push rod 4 can push the seat 1*c*. By the push rod 4 pushing up the seat 1*c* of the rocker arm 1, the rocker arm 1 pivots or rocks around the pivot support receiving portion 41 formed at its middle. This pivoting causes valve 2 to open. Valve 3 is similarly caused to open by rocking action of its associated rocker arm. As shown in FIGS. 1 and 3, tappet 5 has a hemi-spherical rod seat 5*a* formed in its top, which engages with the bottom of the push rod 4 in such a manner that the tappet can push the push rod. The bottoms of the tappets 5 engage the cams 6 on a cam shaft 8 for driving the inlet and exhaust valves. The cams 6 reciprocate the tappets 5 up and down at the desired timing.

As is the case with a known four-cycle engine, the cam shaft 8 is coupled through gears (not shown) to a crankshaft C (FIG. 5), which is parallel with the cam shaft 8, in such a manner that the cam shaft 8 rotates at half the revolution speed of the crankshaft C.

Figure 2:
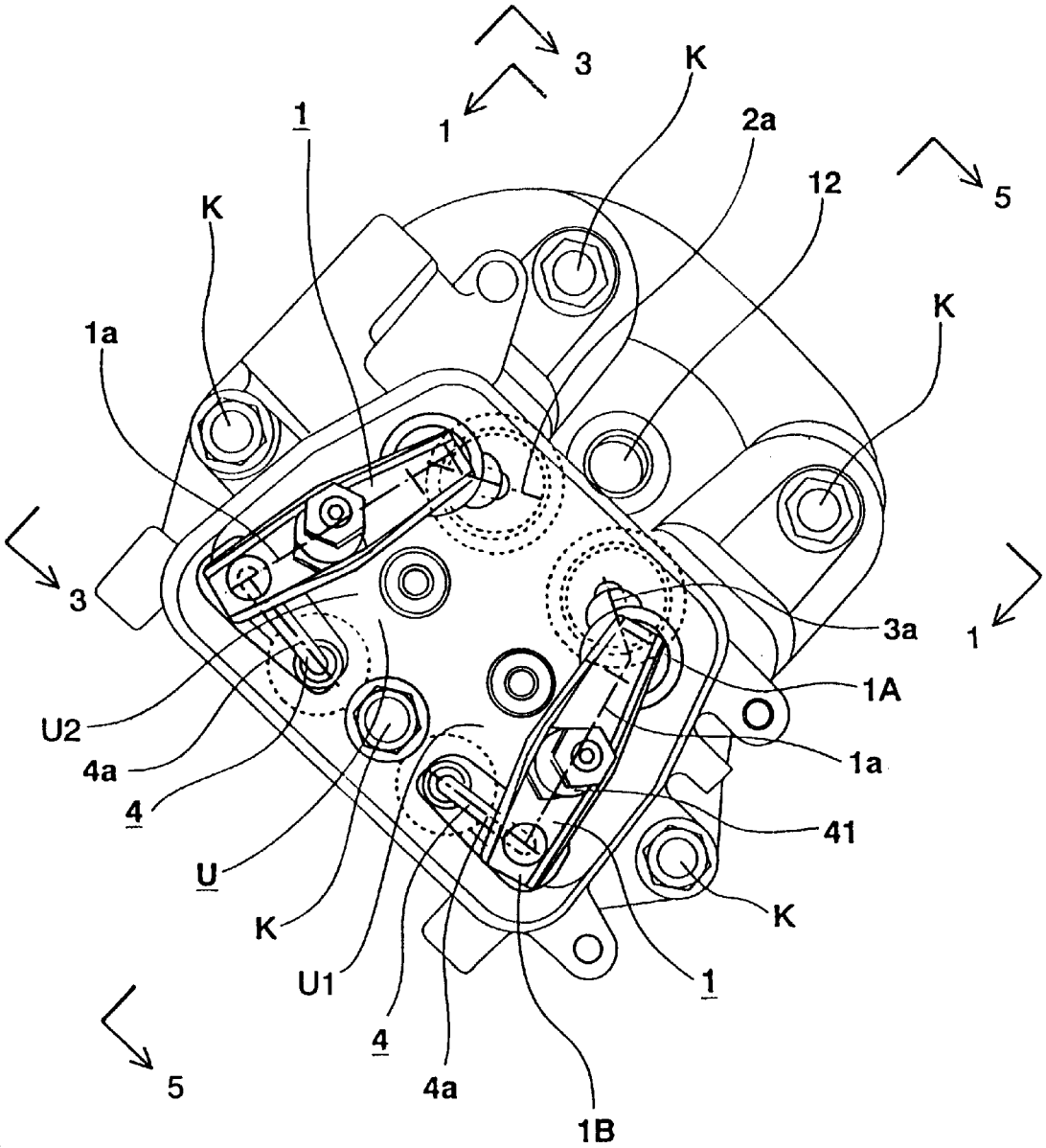
FIG. 2 is a plan view taken along section line 2—2 of FIG. 1 with the head cover and the ignition plug removed, showing the arrangement of the rocker arms, the valve stems and the push rods.

As shown in FIG. 2, in the case of the valve structure of this overhead-valve engine, the rocker arms 1 are arranged or positioned substantially in the shape of a "V" in plan view. That is, the longitudinal center line of the inlet rocker arm is inclined relative to the longitudinal center line of the outlet rocker arm to form an acute angle therebetween. Specifically, the distance between the rocker arm ends that are adjacent the valves is shorter than the distance between the rocker arms ends that are adjacent the push rods.

Figures 10A, 10B, 10C:
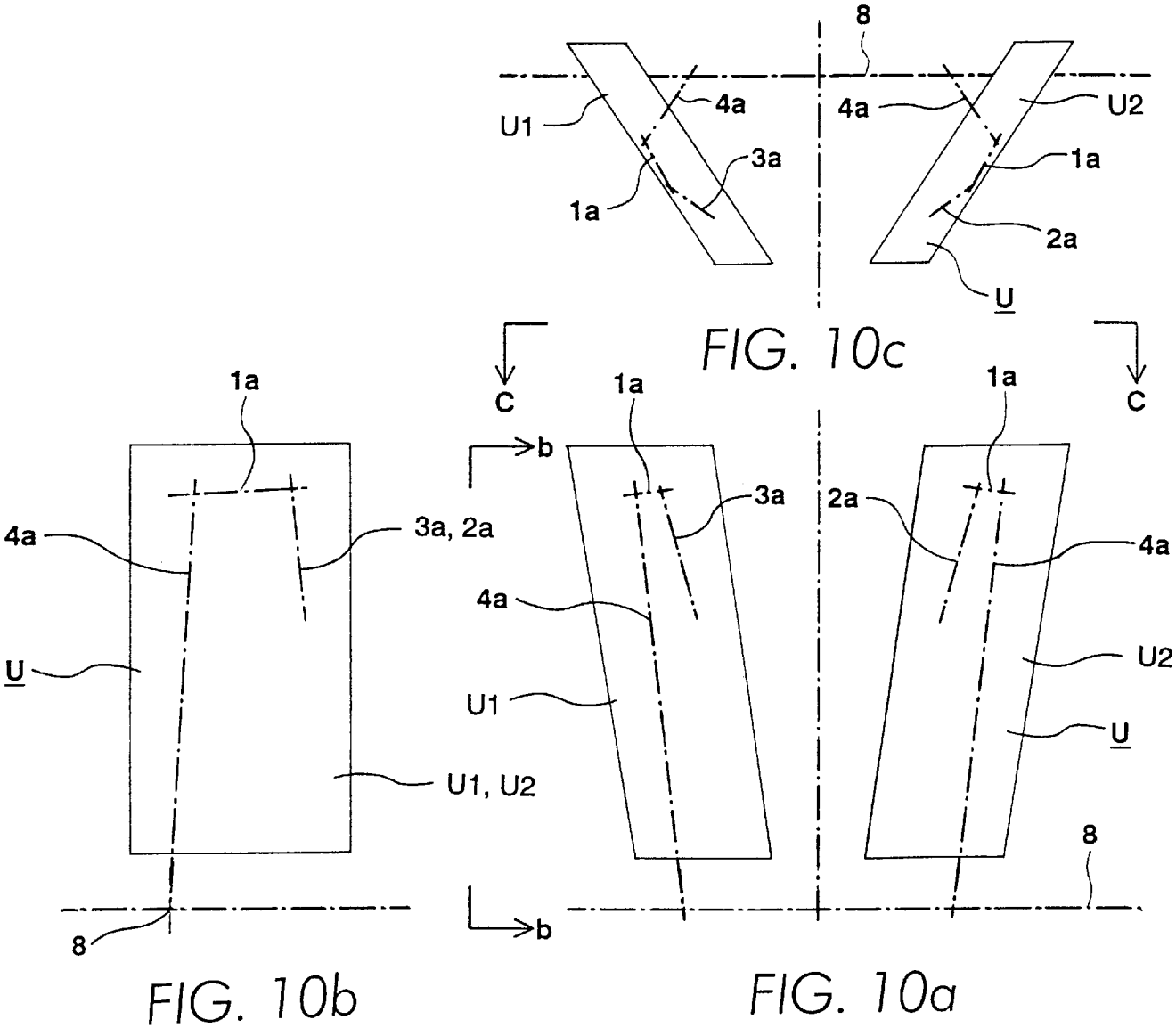
FIG. 10 is a series of diagrams showing the positions, on an inclined plane, of each valve, the associated push rod and the associated rocker arm of the valve structure of an overhead-valve engine according to an embodiment of the invention.

The longitudinal center line 1*a* of the rocker arm 1 on the exhaust side, the longitudinal center line 4*a* of the associated push rod 4, and the longitudinal center line 2*a* of the exhaust valve 2 are positioned on a first inclined plane U2 (see FIGS. 2 and 10). In short, the valve structure on the exhaust side is such that the center lines 1*a*, 4*a* and 2*a* are positioned on a first inclined plane U2.

Likewise, the valve structure on the inlet side is such that the longitudinal center line 1*a* of the rocker arm 1 on the inlet side, the longitudinal center line 4*a* of the associated push rod 4, and the longitudinal center line 3*a* of the inlet valve 3 are positioned on a second inclined plane U1. The center line 1*a* of the rocker arm 1 is the line connected between the center of the valve push portion 1*b* (substantially the radius center of the cylindrical portion in the longitudinal direction and the center of the contact area on the associated valve in the lateral direction) and the center of the hemisphere of the seat 1*c*. The center lines 2*a* and 3*a* of the valves 2 and 3, respectively, are the axes of the valves. The center line 4*a* of the push rod 4 is the axis of the push rod 4.

FIG. 10 shows schematically or diagrammatically the positions of the center lines 1*a*, 4*a* and 2*a* on the exhaust side, which are located on the inclined plane U2, or of the center lines 1*a*, 4*a* and 3*a* on the inlet side, which are located on the other inclined plane U1. FIG. 10 includes a front view (FIG. 10(*a*)), a side view (FIG. 10(*b*)) and a plan view (FIG. 10(*c*)) of the engine.

As shown in FIG. 9, the spherical (hemi-spherical) pivot support receiving portion 41 formed in the middle of the rocker arm 1 is supported through an adjuster 13. The valve push portion 1*b* and the seat 1*c* of the rocker arm 1 can pivot or rock around the receiving portion 41.

The ends of the rocker arm 1 contact the tops of the push rod 4 and the valve 2 or 3, respectively. The adjuster 13 has a spherical surface at its bottom, which is a pivotal center, and a mounting internal thread formed at its center. The pivot support receiving portion 41 in the middle of the rocker arm 1 is supported by the adjuster 13 pivotably on an arm support bolt 42, which is fixed to the cylinder head H. Therefore, the rocker arm 1 rocks around the spherical surface of the adjuster 13 in accordance with the movement of the push rod 4 or the valve 2 or 3.

As shown in FIG. 8, it is preferable that the pivot support receiving portion 41 be positioned on the longitudinal center line 1*a* of the rocker arm 1 so that, when the rocker arm 1 rocks, little torsion is produced. It is not always necessary, however, that the receiving portion 41 be positioned on the center line 1*a*, if a mechanism which may constrain torsion for example by making contact between the side surface of the adjuster 13 and the side ribs 43 of the rocker arm 1, is provided for restraining the rocker arm 1 from twisting.

As shown in FIG. 9, the valve clearance between the valve push rod portion 1*b* of the rocker arm 1 and the stem head 21*a* or 31*a* can be adjusted in accordance with the axial position of the adjuster 13 with respect to the arm support bolt 42 in engagement with adjuster 13. After the clearance is set, the adjuster 13 is locked to the bolt 42 with a screw 44.

It is preferable that the axis of the rocker arm support bolt 42 be positioned on the inclined plane U1 (or U2), because this makes it possible to position the associated rocker arm 1 in such a manner that the rocker arm 1 inclines easily. The arrangement of the rocker arm support bolt 42 is not limited to the above configuration, however, provided that the rocker arm 1 can rock.

Figure 11:
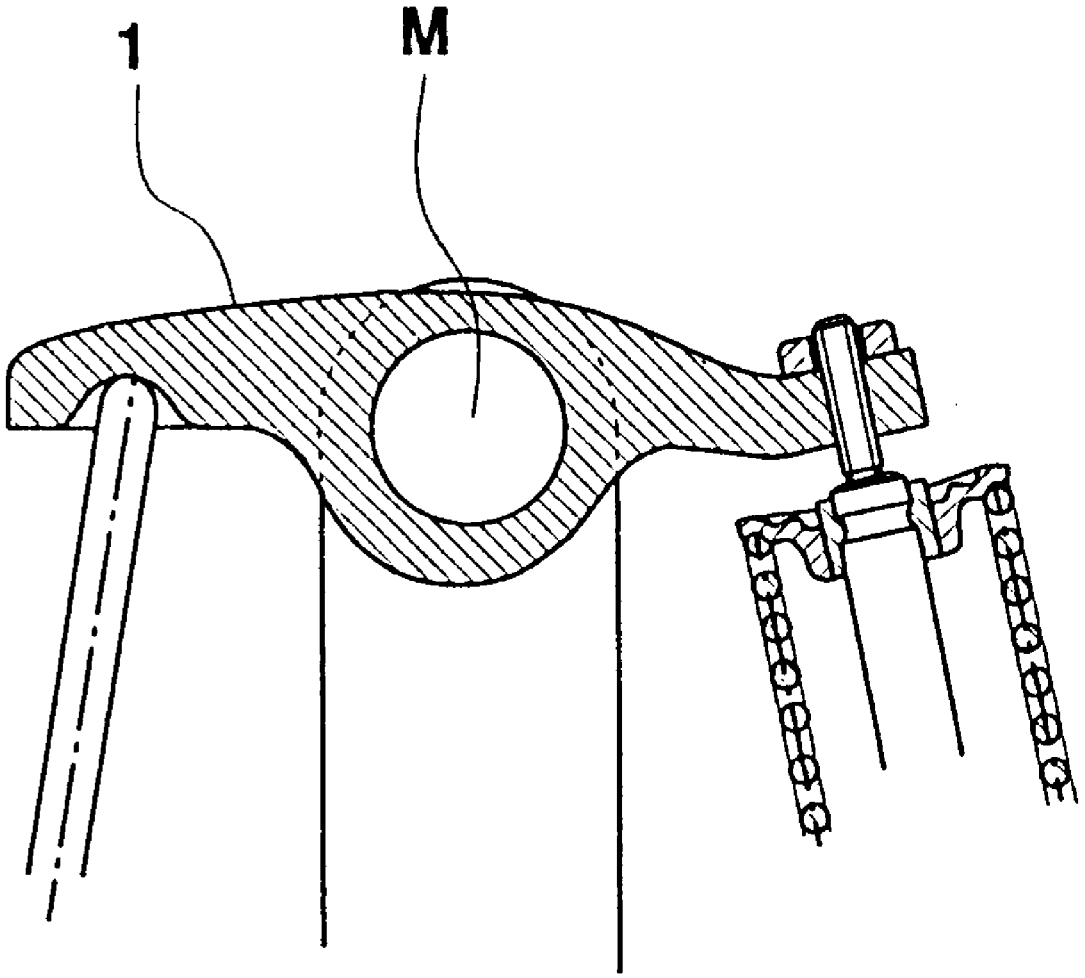
FIG. 11 is a cross section showing the structure of the rocker arms, the push rods and the valves of another embodiment than that of FIG. 9.

As stated above, the rocker arm 1 of this embodiment is a pivot type having a spherical surface as its pivotal center. Alternatively, rocker arm 1 of the present invention may be used with a known structure which rocks around a shaft as shown in FIG. 11, provided that the center line 1*a* of the rocker arm 1, the center line 4*a* of the associated push rod 4, and the center line 2*a* (or 3*a*) of the associated valve 2 (or 3) are positioned on substantially one inclined plane, and a rocker arm 1 rocks on a shaft M which extends perpendicularly to the longitudinal direction of the rocker arm 1.

Figure 5:
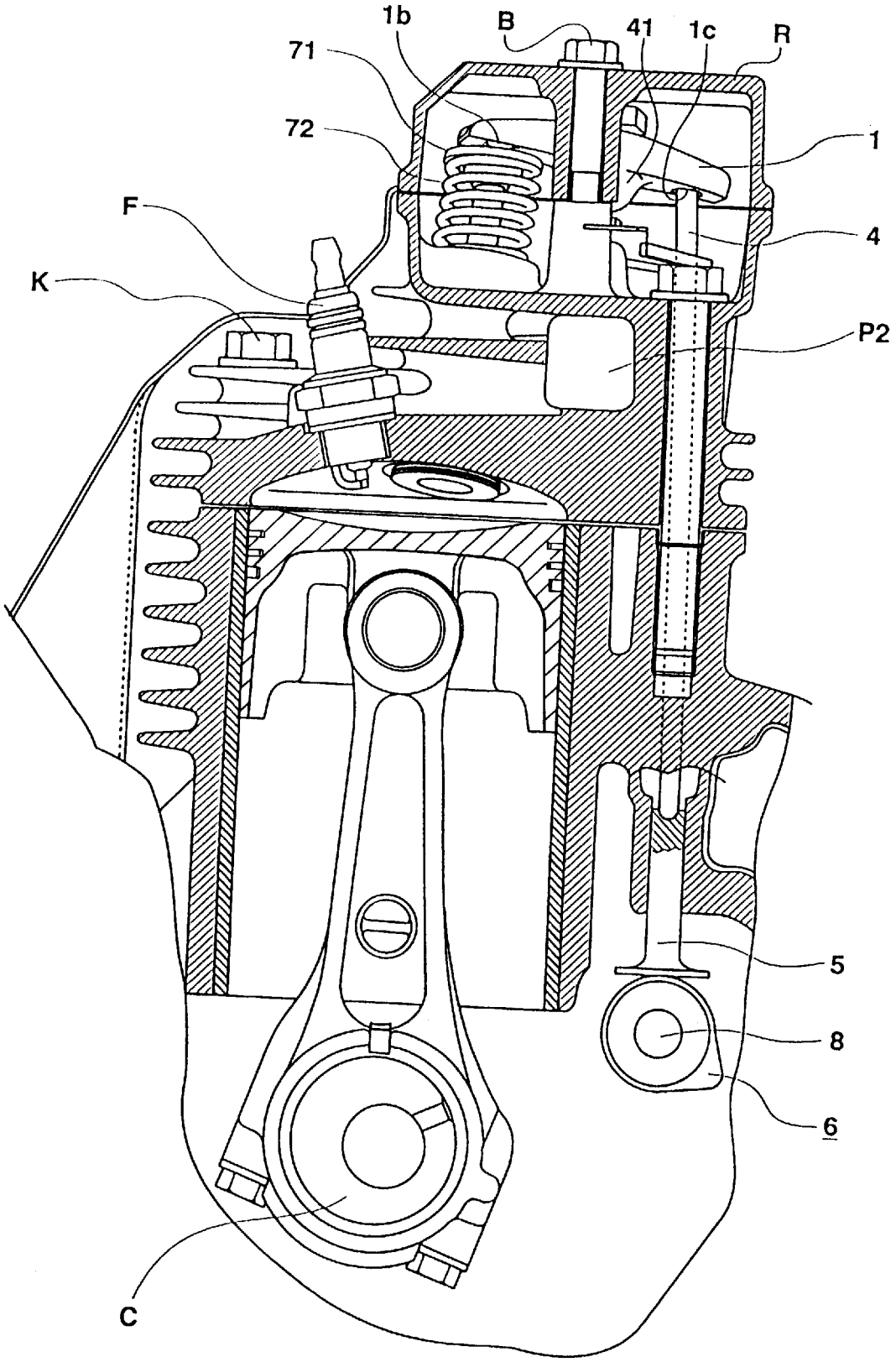
FIG. 5 is a cross section taken along section line 5—5 of FIG. 2 and in the middle of the cylinder head, schematically showing the overall structure of the overhead-valve engine.
Figure 6:
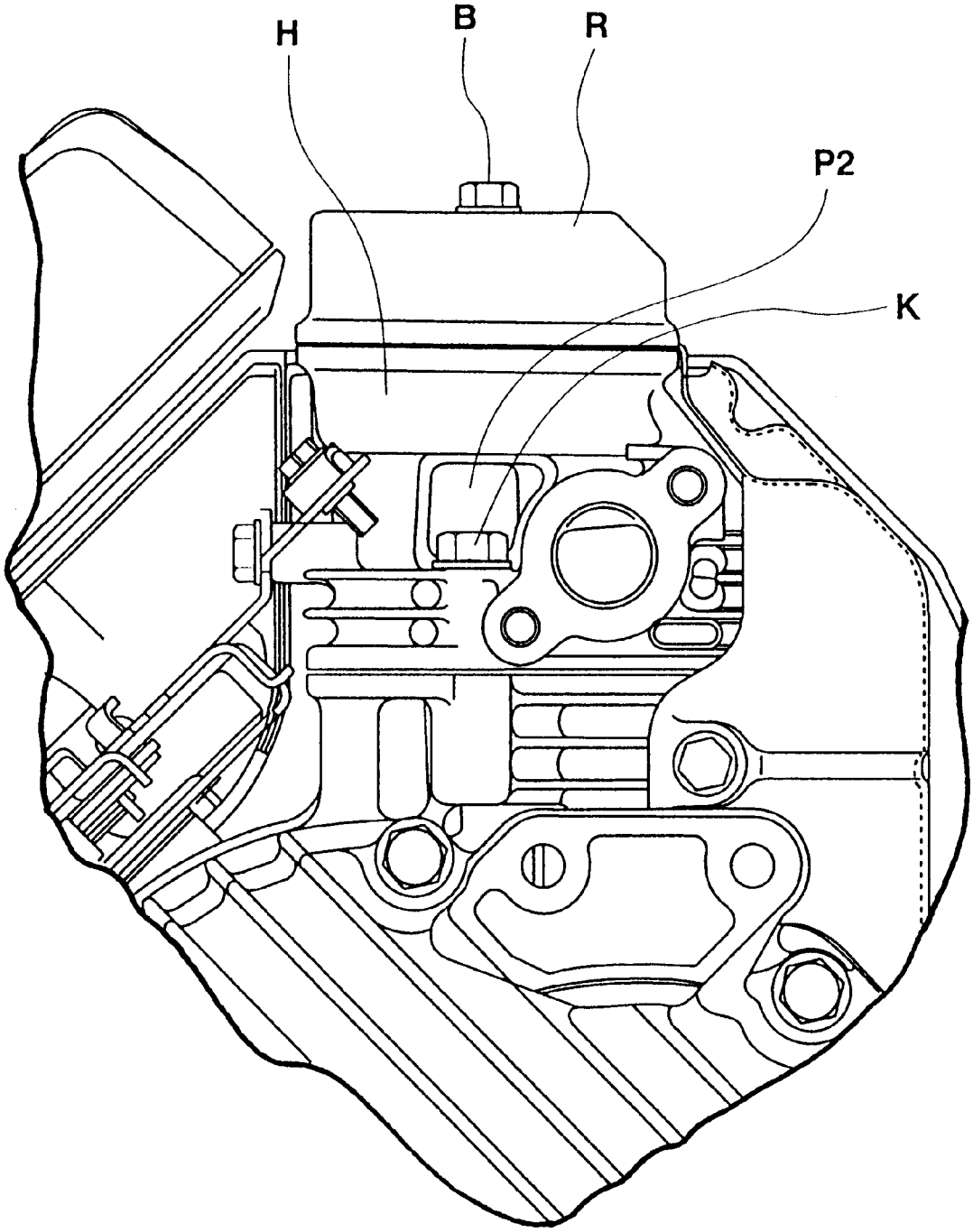
FIG. 6 is a left side view of the engine, showing the appearance of the cylinder head.

As shown in FIGS. 1 and 3–7, the cylinder head is covered with a cylinder head cover R. As shown in FIG. 5, the cylinder head cover R is fixed in its middle to the head H with two bolts B (FIGS. 4–6).

The cylinder head H of the overhead-valve engine having the foregoing valve structure may have, as shown in FIGS. 1 and 3–6, a cooling air passage P1 formed between the valves 2 and 3 and between the push rods 4 and 4, and a cooling air passage P2 between the valve 2 and the associated push rod 4 and between the valve 3 and the associated push rod 4. In other words, the passages P1 and P2 extend in the head H in such a manner that they cross in plan view of the engine, in order to cool the cylinder head effectively with air.

Figure 7:
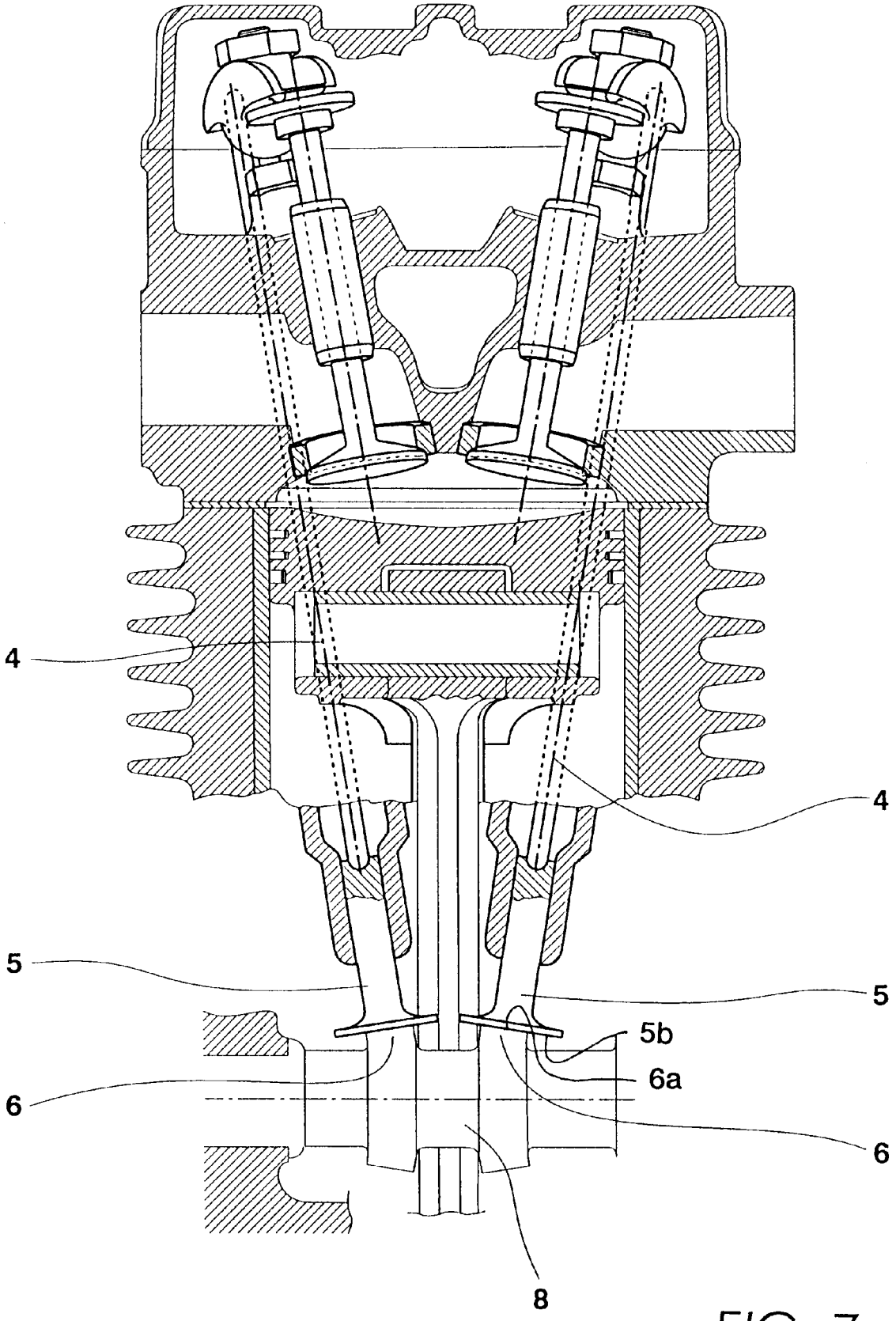
FIG. 7 is a front view in section showing the structure of the cams and valves of another embodiment. Similarly to FIG. 1, an upper part of FIG. 7 is a cross section taken along the valves, and a lower part is a cross section taken along the tappets.
Figure 8D:
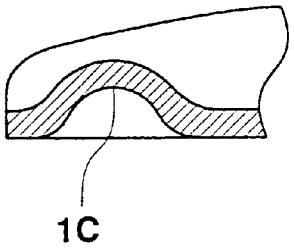
FIG. 8 is a detailed series of views showing the structure of the rocker arms of the embodiment.
Figure 8C:
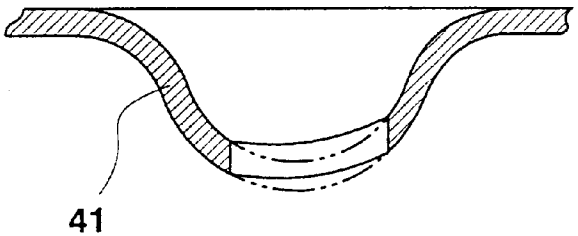
Figure 8B:
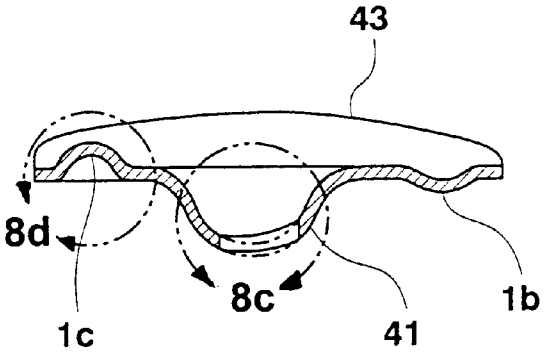
Figure 8A:
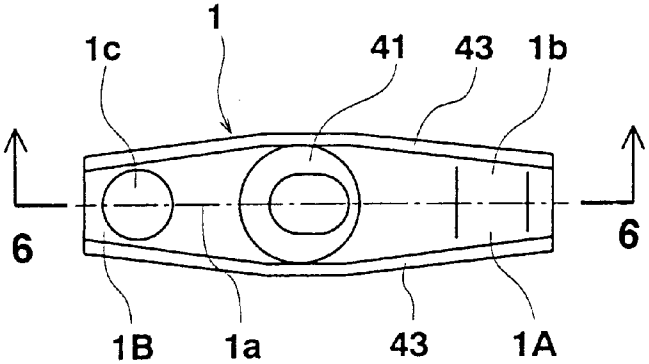

As shown in FIG. 1, the cam 6 of this embodiment has a contact surface 6*a* in parallel with the axis of the cam shaft 8, and the contact surface 6*a* contacts with the associated tappet 5. FIG. 7 shows another embodiment, where the cam 6 has a contact surface 6*a* perpendicular to the axes of the associated tappet 5 and push rod 4 in front view. In other word the cam surface inclines toward the axis of the cam shaft. This arrangement is preferred because when the valve is driven, the driving force is transmitted from the associated cam surface 6*a* linearly or straight to the associated tappet 5 and push rod 4, and no sideways thrust acts on either of the push rod 4 or tappet 5.

In FIG. 1, an exhaust passage 10 leads the exhaust gas from the combustion chamber through an exhaust port 10*a* which is opened and closed by exhaust valve 2, toward a muffler (not shown). Similarly, an inlet passage 11 directs the air-fuel mixture from the carburetor into the cylinder through a inlet port 11*a* which is opened and closed by inlet valve 3. An ignition plug F which is screwed into the ignition hole 12 provides the ignition spark. Piston W reciprocates inside cylinder block E. The cylinder head is secured to the cylinder block by bolts K.

As stated above, the longitudinal center lines 1*a* of exhaust side rocker arm 1, the longitudinal center lines 4*a* of exhaust side push rod 4, and the longitudinal center lines 2*a* of the exhaust valve 2 side are positioned on the inclined plane U2. Likewise, the longitudinal center lines 1*a* of inlet side rocker arm 1, the longitudinal center lines 4*a* of inlet side push rod 4, and the longitudinal center lines 3*a* of the inlet valve 3 are positioned on a second inclined plane U1. Consequently, when the valve is driven, the vectors acting on the associated parts lie on the associated plane U1 or U2. Therefore, the valve mechanism functions smoothly, and no harmful or no useless force acts on their parts.

In the embodiment shown in FIG. 7, both the inlet cam surface 6*a* and the outlet cam surface are inclined at angles other than 90 degrees with respect to the camshaft longitudinal axis. Inlet cam following tappet surface 5*b* and the outlet cam following tappet surface are aligned along the same angle as the cam surface. Similarly, each tappet 5 has a longitudinal axis inclined at an angle other than 90 degrees with respect to the camshaft. For each tappet, the cam following surface of the tappet is generally perpendicular to the tappet longitudinal axis and the longitudinal axis of the associated push rod 4. In this configuration as well, no sideways thrust acts on the contact portion between the associated tappet 5 and push rod 4.

What is claimed is:

1. A valve structure for an overhead-valve engine, comprising:

an inlet valve for allowing air into a combustion chamber of the engine;

an outlet valve for allowing exhaust gas out of the combustion chamber;

an inlet rocker arm actuated by an inlet push rod for actuating the inlet valve; and an outlet rocker arm actuated by an outlet push rod for actuating the outlet valve; wherein:

the outlet valve is inclined relative to the inlet valve to define a first acute angle therebetween;

respective longitudinal center lines of the inlet valve, the inlet push rod, and the inlet rocker arm lie substantially in a first plane, wherein the inlet valve is declined relative to the inlet push rod to define a second acute angle therebetween; and respective longitudinal center lines of the outlet valve, the outlet push rod, and the outlet rocker arm lie substantially in a second plane, wherein the outlet valve is declined relative to the outlet push rod to define the second acute angle therebetween;

wherein the exhaust and inlet valves are aligned parallel to the exhaust and inlet rods alignment.

2. The valve structure of claim 1 wherein:

said longitudinal center line of the inlet rocker arm is inclined relative to the longitudinal center line of the outlet rocker arm to form an acute angle therebetween.

3. The valve structure of claim 2 wherein:

each of said rocker arms has a valve end adjacent its associated valve and a push rod end adjacent its associated push rod; and said rocker arm valve ends are spaced more closely together than said rocker arm push rod ends.

4. The valve structure of claim 3 further comprising:

respective rounded pivot support structures on which each of said rocker arms rock.

5. The valve structure of claim 4 wherein said rounded pivot support structure is hemi-spherical shaped.

6. The valve structure of claim 1 further comprising:

a camshaft having a longitudinal axis, the camshaft further having an inlet cam surface and an outlet cam surface, each cam surface inclined at an angle other than 90 degrees with respect to the camshaft longitudinal axis;

an inlet tappet for activating the inlet push rod; and an outlet tappet for activating the outlet push rod;

each tappet having a respective longitudinal axis inclined at an angle other than 90 degrees with respect to the camshaft, each tappet further having a respective cam following surface generally perpendicular to said respective tappet longitudinal axis.

7. The valve structure of claim 1, wherein each rocker arm has a first rounded surface for actuating its associated push rod, and a second rounded surface for actuating its associated valve.

8. The valve structure of claim 7, wherein said first rounded surface is generally hemi-spherically shaped.

9. The valve structure of claim 1 wherein each rocker arm has:

a first rounded concave surface for engaging the rocker arm's associated push rod; and a second rounded convex surface for engaging the rocker arm's associated valve.

10. The valve structure of claim 1 wherein:

the first plane and the second plane are substantially symmetrical.

11. A valve structure for an overhead-valve engine, comprising:

an inlet valve for allowing air into a combustion chamber of the engine;

an outlet valve for allowing exhaust gas out of the combustion chamber;

an inlet rocker arm actuated by an inlet push rod for actuating the inlet valve; and an outlet rocker arm actuated by an outlet push rod for actuating the outlet valve; wherein:

the outlet valve is inclined relative to the inlet valve to define an acute angle therebetween;

respective longitudinal center lines of the inlet valve, the inlet push rod, and the inlet rocker arm lie substantially in a first plane;

respective longitudinal center lines of the outlet valve, the outlet push rod, and the outlet rocker arm lie substantially in a second plane;

the longitudinal center line of the inlet rocker arm is inclined relative to the longitudinal center line of the outlet rocker arm to form an acute angle therebetween;

each of said rocker arms has a valve end adjacent its associated valve and a push rod end adjacent its associated push rod;

said rocker arm valve ends are spaced more closely together than said rocker arm push rod ends; and respective rounded pivot support structures on which each of said rocker arms rock.

12. The valve structure according to claim 11, wherein the rounded pivot support structure is hemispherically shaped.

13. The valve structure according to claim 12, including an adjuster having a spherical pivotal end associated with each of the rounded pivot support of the rocker arm.

14. The valve structure according to claim 11, including:

a first shaft coupled to the engine and perpendicular to the first plane, a second shaft coupled to the engine and perpendicular to the second plane;

wherein the respective rounded pivot support structures of the rocker arm is a circular opening pivotally engaged to the respective shafts.

15. The valve structure according to claim 11, wherein each rocker arm has a first rounded surface for actuating its associated push rod, and a second rounded surface for actuating its associated valve.

16. The valve structure according to claim 11, wherein said rounded pivot support structure is spherically shaped.

* * * * *